US006726492B1

(12) United States Patent
Yu

(10) Patent No.: US 6,726,492 B1
(45) Date of Patent: Apr. 27, 2004

(54) GROUNDED ELECTRICAL CONNECTOR

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/452,159

(22) Filed: May 30, 2003

(51) Int. Cl.[7] ..... H01R 13/648
(52) U.S. Cl. ..... 439/108; 434/607; 434/74
(58) Field of Search ..... 439/108, 101, 439/74, 660, 607, 609

(56) References Cited

U.S. PATENT DOCUMENTS 5,626,482 A * 5/1997 Chan et al. ..... 439/74
5,697,799 A * 12/1997 Consoli et al. ..... 439/181
5,860,814 A * 1/1999 Akama et al. ..... 439/74
5,915,976 A 6/1999 McHugh
6,019,616 A * 2/2000 Yagi et al. ..... 439/108
6,250,935 B1 * 6/2001 Mochizuki et al. ..... 439/74
6,464,515 B1 10/2002 Wu

* cited by examiner

*Primary Examiner*—Hien Vu
(74) *Attorney, Agent, or Firm*—Wei Te Chung

(57) ABSTRACT

An electrical connector (1) includes an insulative housing (10), a number of signal contacts (22), a grounding contact (24), a shielding member (30), and a grounding member (40). The insulative housing defines a number of passageways (16) therein. The signal contacts and the grounding contact are received in the passageways of the insulative housing. The shielding member is attached on an outer side of the insulative housing. The grounding member is attached to bottom of the insulative housing and includes a base portion (41), an arm portion (42, 44), and a space (45) defined between the base portion and the arm portion. The base portion abuts the grounding contact and the arm portion abuts the shielding member, thereby forming a stable and reliable grounding path between the grounding contact and the shielding member.

8 Claims, 3 Drawing Sheets

GROUNDED ELECTRICAL CONNECTOR

BACKGROUND OF THE INVENTION

1. Field of the Invention

The present invention relates to an electrical connector, and more particularly to a grounded board-to-board connector.

2. Description of the Related Art

Board-to-board connector assembly generally includes a plug and a receptacle connectors respectively mounted on two printed circuit boards and mated with each other for mechanical and electrical interconnection therebetween, whereby the corresponding printed circuit boards can be electrically connected with each other for signal transmission.

The conventional board-to-board connector assembly can be referred to U.S. Pat. No. 5,915,976 which discloses a plug and a corresponding receptacle connector. The receptacle connector includes a housing, a number of contacts disposed in inner opposite sides of the insulative housing, and a pair of shielding plates positioned on outer opposite sides of the insulative housing. Each shielding plate has a number of hooks extending from a bottom end thereof. The hooks extend into the insulative housing and contact with predetermined contacts for forming a grounding path to filter noises and EMI (electromagnetic interference).

With high speed and high frequency signals transmitting in the board-to-board connector assembly, contacts of the connector assembly generate much more quantity of heat comparing with low speed and low frequency signals transmission. However, there is no enough room inside the mated connector assembly for meeting the requirements of heat dissipation. Thus, an appropriate approach is to increase the height of the receptacle connector to provide additional room. Accordingly, the shielding plate has to be heightened to match the heightened receptacle connector. Whereas, such heightened shielding plate is readily warped in manufacturing, which will cause the contact between the hooks of the shielding plate and the predetermined contacts unstable or even break, thereby degrading the effect of filtering EMI and resulting in poor transmission of signals.

Hence, an improved electrical connector is required to overcome the disadvantages of the prior art.

SUMMARY OF THE INVENTION

A major object of the present invention is to provide an electrical connector having a stable and reliable grounding means for filtering noises and EMI.

In order to achieve the object set forth, an electrical connector comprises an insulative housing, a plurality of signal contacts, a grounding contact, a shielding member, and a grounding member. The insulative housing defines a plurality of passageways therein. The signal contacts and the grounding contact are received in the passageways of the insulative housing. The shielding member is attached on an outer side of the insulative housing. The grounding member is attached to bottom of the insulative housing and comprises a base portion, an arm portion, and a space defined between the base portion and the arm portion. The base portion tightly abuts the grounding contact and the arm portion tightly abuts the shielding member, thereby forming a stable and reliable grounding path between the grounding contact and the shielding member.

Other objects, advantages and novel features of the invention will become more apparent from the following detailed description when taken in conjunction with the accompanying drawings.

DETAILED DESCRIPTION OF THE INVENTION

Figure 1:
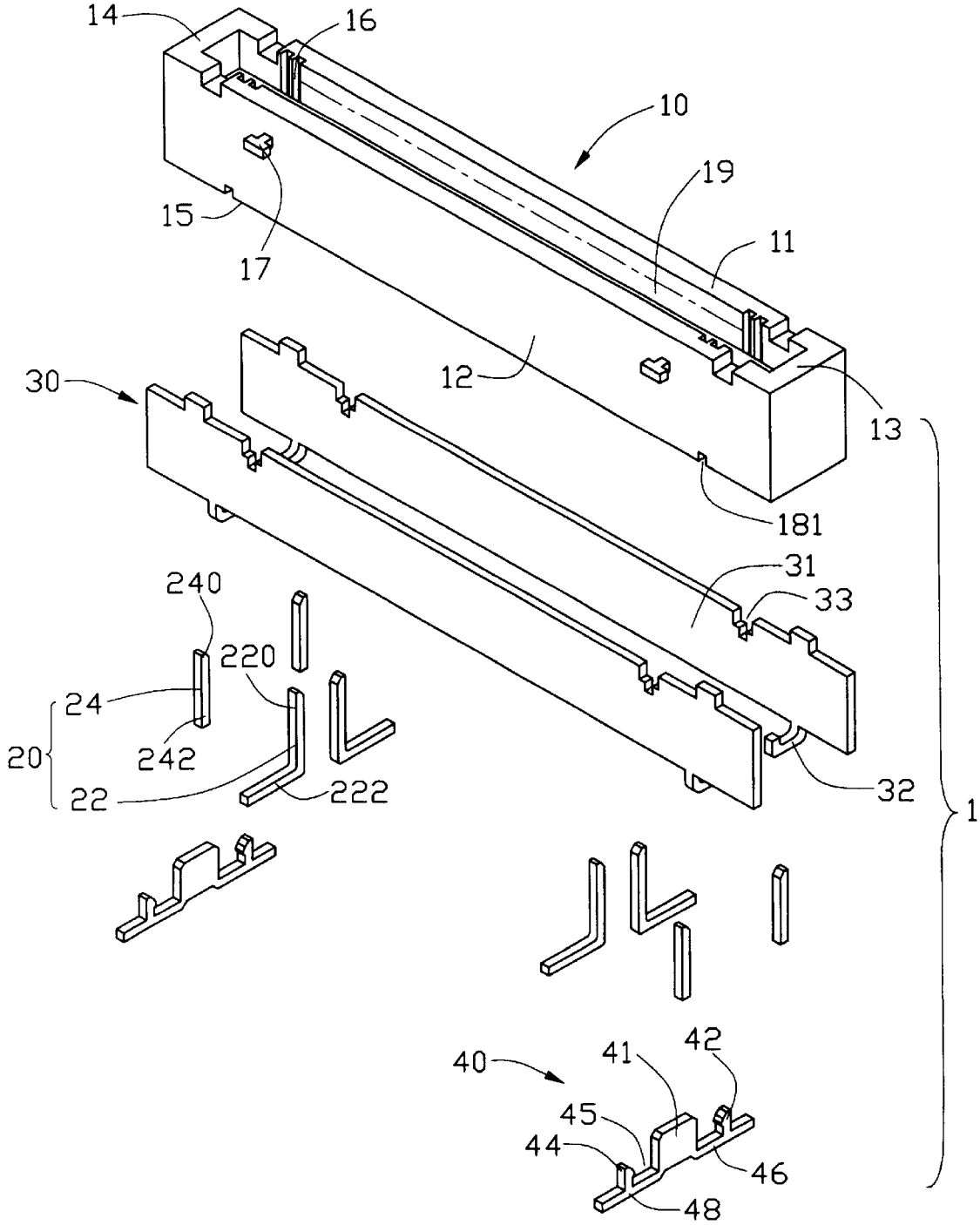
FIG. 1 is an exploded, perspective view of an electrical connector in accordance with the present invention.
Figure 2:
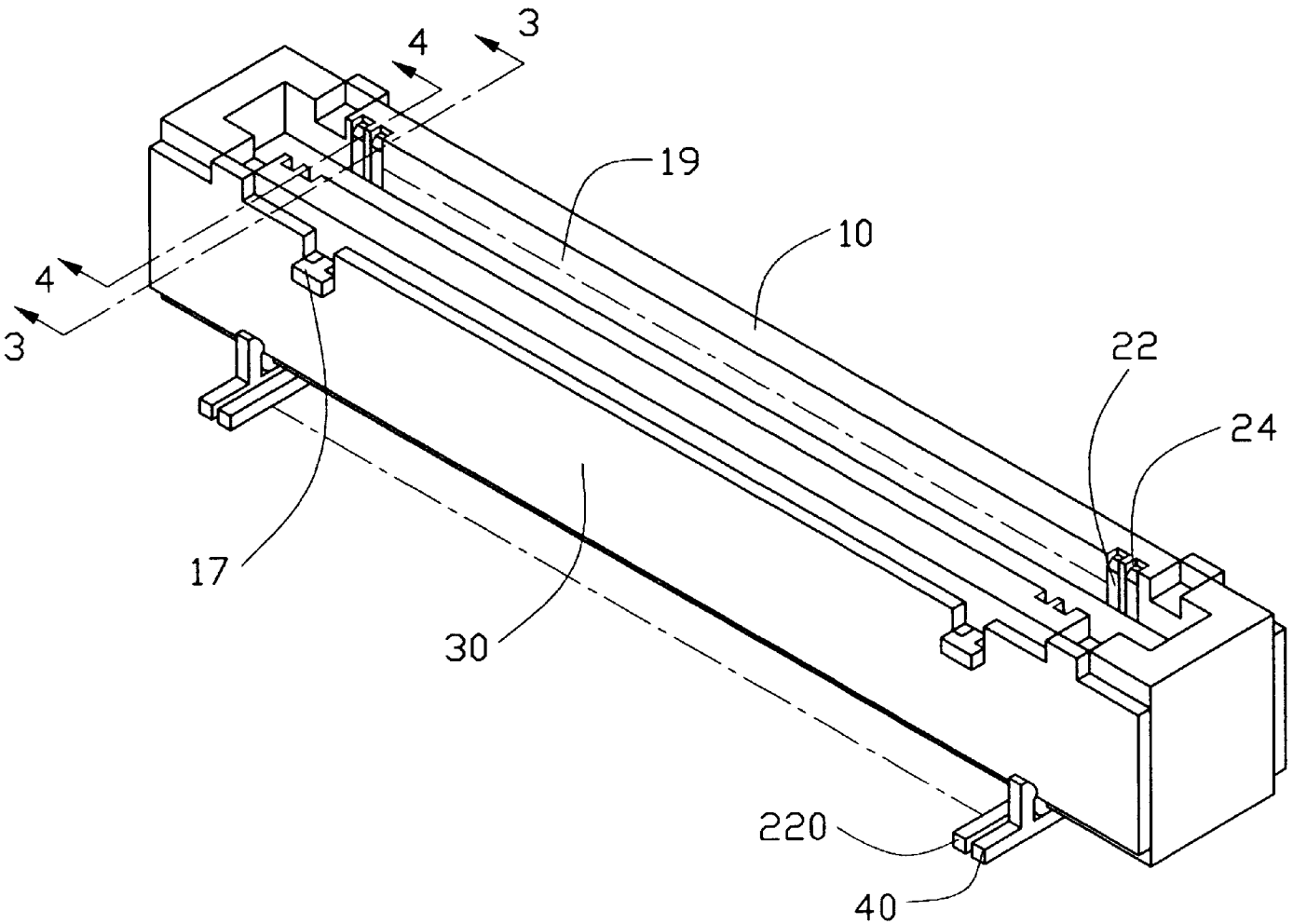
FIG. 2 is an assembled, perspective view of the electrical connector of FIG. 1.

Referring to FIGS. 1 and 2, an electrical connector 1 comprises an insulative housing 10, a plurality of contacts 20, a shielding member 30, and a grounding member 40.

The insulative housing 10 is elongate and comprises a pair of side walls 11, 12, a pair of end walls 13, 14 connecting the side walls 11, 12, and a bottom wall 15 connecting the side and end walls 11, 12, 13, 14. The side, end and bottom walls define a receiving cavity 19 therebetween for receiving a complementary connector (not shown). The side walls 11, 12 define a plurality of passageways 16 extending through the bottom wall 15 (shown in FIGS. 3 and 4) in opposite inner side faces thereof, and are formed with two pairs of projections 17 on outer faces thereof. The bottom wall 15 defines a number of notches 18 (shown in FIG. 4) communicating with predetermined passageways 16 and located between the side walls 11, 12, and a number of pairs of apertures 181 with each pair communicating with one corresponding notch 18 and extending through the respective side walls 11, 12.

The contacts 20 include signal contacts 22 and grounding contacts 24. Each signal contact 22 has a contacting section 220 and a tail section 222 extending perpendicular to the contacting section 220. Each grounding contact 24 has a contacting section 240 at an upper portion thereof and a tail portion 242 at a low portion thereof.

The shielding member 30 comprises a pair of shielding plates. Each shielding plate has an elongated main portion 31 and a number of hooks 32 extending from a lower section of the main portion 31. The main portion 31 defines a plurality of cutouts 33 at an upper section thereof.

The grounding member 40 comprises a number of grounding plates. Each grounding plate is stamped from a metal sheet, which includes a base portion 41, a pair of leg portions 46, 48 extending laterally from lower ends of opposite sides of the base portion 41, a pair of arm portions 42, 44 extending substantially parallel to the leg portions 46, 48 respectively, and two spaces 45 defined between the base portion 41 and the arm portions 42, 44. Each arm portion 42 (44) is formed with a protrusion 421 (441) projecting toward the base portion 41 at a distal end thereof.

Figure 3:
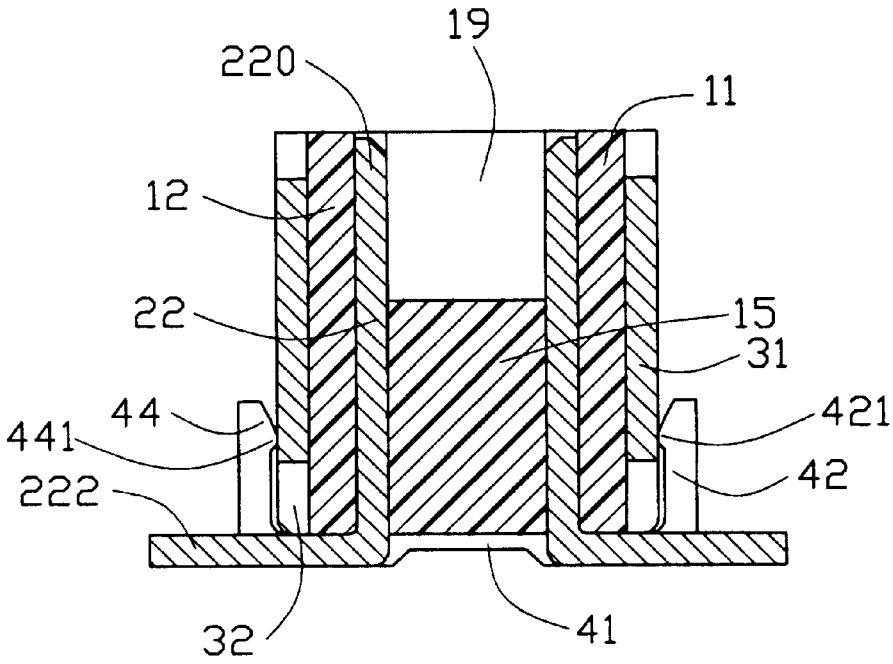
FIG. 3 is a cross-sectional view taken along line 3—3 of FIG. 2.
Figure 4:
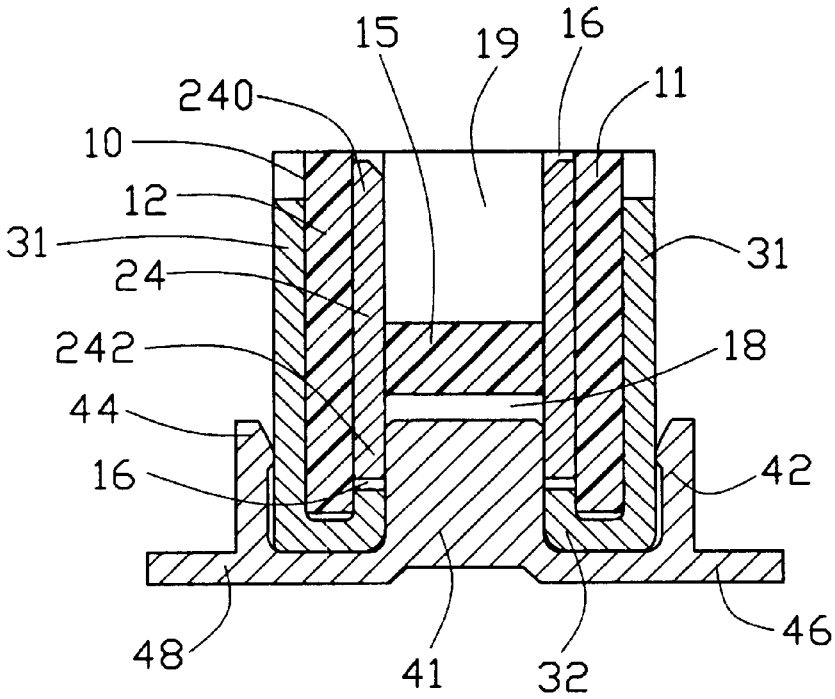
FIG. 4 is a cross-sectional view taken along line 4—4 of FIG. 2.

In conjunction with FIGS. 3 and 4, in assembly, the signal contacts 22 are inserted in the passageways 16 from bottom of the insulative housing 10 with the tail portions 222 thereof remaining outside. The grounding contacts 24 are inserted into the predetermined passageways 16. The shielding plates are attached on the outer faces of the side walls 11, 12 in a bottom-to-top direction. The cutouts 33 of the shielding plates respectively receive the projections 17 of the insulative housing 10 for preventing the shielding plates upwardly and sidewardly moving. The hooks 32 are received in the corresponding apertures 181 and hooked with the respective side walls 11, 12. A distal end of each hook 32 is located preferably below the corresponding grounding contact 24. The hook 32 may contact or not contact the grounding contact 24.

The grounding plate is assembled to the bottom wall 15 of the insulative housing 10. The base portion 41 is received in the corresponding notch 18. The space 45 forcibly receive lower portions of the corresponding shielding plate, side wall 11 (12), and grounding contact 24. At this time, the base portion 41 tightly abuts against the tail section 242 of the grounding contact 24, and the arm portion 42 (44) abuts against the shielding plate 30 preferably with the protrusion 421 (441) thereof tightly abutting the shielding plate. By this structure, a stable and reliable grounding path can be established between the shielding plate and the grounding contact even though the shielding plate is out of contact with the grounding contact.

In alternative embodiments, the shielding plate may need no hooks. The configuration can provide the same effects as obtained by the above embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of first passageways and a second passageway therein;

a plurality of signal contacts received in the first passageways of the insulative housing;

a grounding contact received in the second passageway of the insulative housing;

a shielding member attached to the insulative housing; and a grounding member attached to the insulative housing and electrically connected with the grounding contact and the shielding member wherein the grounding member comprises a base portion abutting against the grounding contact, an arm portion abutting against the shielding member, and a space defined between the base portion and the arm portion;

wherein the insulative housing comprises a pair of side walls defining the passageways in inner side faces thereof, wherein the shielding member comprises a pair of shielding plates attached on outer faces of the side walls, respectively; and wherein the space of the grounding member snugly receives the grounding contact, the sidewall and the shielding plate.

2. The electrical connector as claimed in claim 1, wherein the grounding member is arranged along a lateral direction of the insulative housing.

3. The electrical connector as claimed in claim 1, wherein the shielding plate comprises a hook hooked with a corresponding side wall and a cutout defined at a top end thereof.

4. The electrical connector as claimed 3, in claim wherein the insulative housing comprises a notch defined at a bottom thereof for receiving the base portion of the grounding member, an aperture communicating with the notch for receiving the hook of the shielding plate, and a projection formed on the side wall for engaging with the cutout of the shielding plate.

5. The electrical connector as claimed in claim 1, wherein the grounding member is planar and comprises a leg portion connecting low ends of the base portion and the arm portion.

6. The electrical connector as claimed in claim 1, wherein the arm portion is substantially parallel to the base portion and has a protrusion at a distal end thereof projecting toward the base portion.

7. An electrical connector comprising:

an insulative housing defining a central receiving cavity, along a lengthwise direction thereof, with a pair of two opposite side walls by two sides thereof;

a plurality of passageways formed in an interior face of each of said side walls;

a plurality of discrete signal contacts received in some of said passageways, respectively;

a plurality of discrete grounding contacts received in others of said passageways, respectively;

a shielding member attached to each of said side walls and substantially covering at least most portions of an interior face of the corresponding side wall; and a grounding member assembled to the housing in alignment with the corresponding grounding contacts along a transverse direction perpendicular to said lengthwise direction, and not only electrically connecting the shielding member and the grounding contacts but also mechanically retain the shielding member in position relative to the housing wherein said grounding member includes a leg portion configured and dimension similar to that of the signal contact, and an arm integrally extends from the leg to abut against an outer face of the corresponding shielding member;

wherein the grounding member includes a base portion mechanically engaging the corresponding grounding contact.

8. An electrical connector comprising:

an insulative housing defining a central receiving cavity, along a lengthwise direction thereof, with a pair of two opposite side walls by two sides thereof;

a plurality of passageways formed in an interior face of each of said side walls;

a plurality of discrete signal contacts received in some of said passageways, respectively;

a plurality of discrete grounding contacts received in others of said passageways, respectively; and a shielding member attached to each of said side walls and substantially covering at least most portions of an interior face of the corresponding side wall; wherein said shielding member includes a plurality of hooks extending from a bottom edge of a main portion thereof and invading the corresponding passageways, respectively, where the corresponding grounding contacts are located wherein said hook and the corresponding grounding contact sharing the same passageway are vertically spaced from each other;

wherein a grounding member is assembled to the housing with a base portion simultaneously mechanically and electrically contacting both the grounding contact and the hook that are located in the same passageway.

* * * * *